United States Patent [19]

Gutschmit

[11] Patent Number: 4,948,067

[45] Date of Patent: Aug. 14, 1990

[54] TEXTILE YARN CREEL

[75] Inventor: Alan Gutschmit, Troy, N.C.

[73] Assignee: Alandale Industries, Inc., Troy, N.C.

[21] Appl. No.: 446,201

[22] Filed: Dec. 5, 1989

[51] Int. Cl.[5] ..... B65H 49/14

[52] U.S. Cl. ..... 242/131; 15/301; 242/131.1

[58] Field of Search ..... 242/131, 131.1; 15/301, 15/303, 300 A, 306; 57/304, 305; 66/125 R

[56] References Cited

U.S. PATENT DOCUMENTS

| | | | |
|---|---|---|---|
| 2,209,203 | 7/1940 | Kahlisch | 242/131.1 |
| 3,486,309 | 12/1969 | Wild | 15/300 A |
| 3,674,223 | 7/1972 | Philip | 242/131 |
| 3,690,586 | 9/1972 | Bock | 242/131 |
| 3,693,904 | 9/1972 | Bucher | 242/131 |
| 3,915,406 | 10/1975 | Rolli et al. | 242/131 |
| 4,077,084 | 3/1978 | Benson et al. | 15/306 A |
| 4,261,532 | 4/1981 | Davis et al. | 242/131 |
| 4,540,138 | 9/1985 | Gutschmit | 242/131 |

OTHER PUBLICATIONS

"Shelton & Memminger Yarn Technology", pp. 7 and 8, Alan Shelton Ltd., Leicestershire, England, Undated, Advertising Brochure.

*Primary Examiner*—Stanley N. Gilreath
*Attorney, Agent, or Firm*—Shefte, Pinckney & Sawyer

[57] ABSTRACT

An adjustable textile yarn creel of circular construction includes a plurality of yarn package supporting assemblies each of which has a frame on which a pair of yarn package supporting members are mountable in parallel at selectively variable spacings. The yarn package supporting assemblies are connected with one another in upright disposition in a circular arrangement by connector assemblies extending between laterally adjacent yarn package supporting assemblies. Yarn is withdrawn radially inwardly of the creel from the yarn packages and transported therefrom through respective guide tubes to an associated textile machine such as a circular knitting machine.

9 Claims, 2 Drawing Sheets

TEXTILE YARN CREEL

BACKGROUND OF THE INVENTION

The present invention relates to textile yarn creels for supporting a plurality of yarn packages for feeding yarns therefrom to a textile knitting machine or like textile apparatus.

U.S. Pat. No. 4,540,138, issued Sept. 10, 1985, entitled "Textile Yarn Creel," by the same inventor as the present invention, discloses a textile yarn creel of a compact circular construction adapted to support multiple yarn packages in a circular arrangement for yarn delivery from the packages radially inwardly to a central area of the creel from which the yarns are directed through conveying tubes to an associated knitting or other textile machine. The creel of this patent provides a circular frame to which plural longitudinal yarn package supporting assemblies may be mounted axially at selected circumferential locations and spacings for permitting the selective increase or decrease of the yarn package storage capacity of the creel within a given circular area defined by the frame. In one embodiment, a rotatable compressed air emission tube having multiple air discharge ports along its length is arranged at the center of the frame for discharging air radially outwardly to remove lint from, and prevent lint accumulation on, the creel and its yarn packages. In an alternative embodiment, a rotary fan is mounted above the frame for the same purpose.

A similar textile yarn creel of a circular construction is manufactured and sold by Alan Shelton, Limited, of Leicestershire, England, under the trade name, "Venticreel." This creel utilizes a plurality of individual creel units each having a pair of upright yarn package supporting members rigidly connected in spaced parallel relation, with the plural creel units being connected to one another in a circular arrangement by frame connectors extending laterally between adjacent creel units. This creel also supports a plurality of yarn packages in a circular array for radially inward yarn delivery as in the creel of U.S. Pat. No. 4,540,138. This creel also offers the ability to selectively increase the yarn package supporting capacity of the creel by the use of additional creel units in the circular arrangement, but with the attendant disadvantage of increasing the overall diameter of, and floor space required by, the creel.

SUMMARY OF THE INVENTION

It is an object of the present invention to provide a textile yarn creel of a circular construction which improves over the above-described prior art creels by providing a greater degree of adjustability in the assembly, capacity and overall size of the creel.

Briefly summarized, the textile yarn creel of the present invention includes a plurality of yarn package supporting assemblies, each of which includes a frame sub-assembly, at least one yarn package supporting member having a plurality of yarn package mounting locations thereon, and an arrangement for mounting the yarn package supporting member at selectively variable positions on the frame sub-assembly. The yarn package supporting assemblies are connected in an annular arrangement by connectors which selectively join the frame sub-assemblies in a manner orienting the associated yarn package supporting members in axial relation to the annular arrangement and generally parallel spaced relation to one another with their yarn package mounting locations facing radially inwardly of the annular arrangement.

In the preferred embodiment, each of the yarn package supporting assemblies includes a pair of the yarn package supporting members, the associated mounting arrangement being adapted for mounting the pair of yarn package supporting members in generally parallel relation at selectively variable spaced positions on the associated frame sub-assembly. Each frame sub-assembly preferably includes a main frame member and a pair of auxiliary frame members movably mounted in opposition to one another on the main frame member, the associated mounting arrangement being adapted for mounting the associated pair of yarn package supporting members respectively to the pair of auxiliary frame members for selective relative positioning of the yarn package supporting members.

Each frame sub-assembly further includes another frame member pivotably mounted centrally to the main frame member for movement between an operative position extending outwardly from the main frame member and a storage position extending alongside the main frame member. Each yarn package supporting assembly includes a longitudinal yarn guiding assembly mounted to such other frame member in generally parallel relation to the pair of yarn package supporting members. In this manner, the yarn guiding assembly is disposed in axial relation to the annular arrangement of the yarn package supporting assemblies radially inwardly of the associated pair of yarn package supporting members when such other frame member of the frame sub-assembly is in its operative position, so that the yarn guiding assembly is adapted to receive yarns withdrawn from yarn packages at the yarn package mounting locations of the yarn package supporting members.

Each yarn package supporting assembly includes a plurality of brackets selectively mountable at varying locations along the yarn package supporting members for supporting a plurality of yarn package mounting elements to form the yarn package mounting locations.

A fan arrangement is disposed centrally of the annular arrangement of the yarn package supporting assemblies for removing and preventing lint accumulation thereon. Preferably, the fan arrangement includes a fan support member disposed axially centrally of the annular arrangement of yarn package supporting members and a plurality of rotary fans mounted to the fan support member and facing radially outwardly of the annular arrangement of yarn package supporting assemblies at axial and circumferential spacings of the fans to one another. A motor or other suitable mechanism is provided for rotating the fan support member about an axis extending generally axially of the annular arrangement of the yarn package supporting assemblies.

DESCRIPTION OF THE PREFERRED EMBODIMENT

Figure 1:
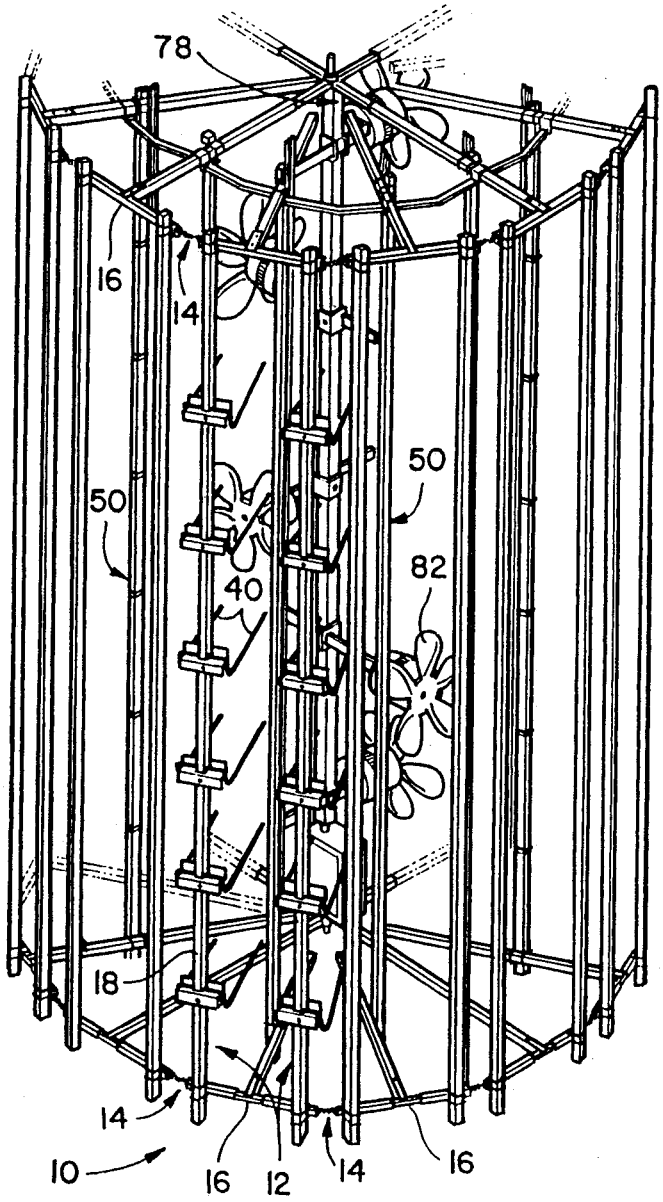
FIG. 1 is a perspective view of a textile yarn creel according to the preferred embodiment of the present invention.

Referring now to the accompanying drawings, a textile yarn creel according to the preferred embodiment of the present invention is generally indicated at 10. For illustrative purposes, the creel 10 is shown as set up for supporting multiple pairs of yarn packages, one package of each pair being in actual yarn feeding use at any given point in time while the other package of the pair awaits placement into use as a replacement for the first package when its yarn supply is exhausted. In this configuration, the creel 10 is particularly adapted for use in supplying yarn to a circular knitting machine or a like textile apparatus. In normal use, the creel 10 would be located in upstanding disposition on the floor of the knitting room directly beside the associated circular knitting machine.

Basically, the creel 10 includes a plurality of yarn package supporting assemblies, generally indicated at 12, disposed in upstanding disposition in an annular, essentially circular arrangement. The yarn package supporting assemblies 12 are joined laterally with one another in the circular arrangement by a plurality of connecting assemblies, generally indicated at 14, extending laterally between adjacent yarn package supporting assemblies 12.

Each yarn package supporting assembly 12 includes upper and lower horizontally-disposed frame sub-assemblies 16 between which extend a pair of vertically disposed longitudinal yarn package supporting members 18 in generally parallel spaced relation. Each frame sub-assembly 16 has a substantially linear main frame member 20, the opposite ends of which support a pair of tubular auxiliary frame members 22 for co-linear telescopical sliding movement relative to the main frame member 20. Each auxiliary frame member 22 carries a set screw 24 by which the main and auxiliary frame members 20, 22 may be fixed in any relative telescopical disposition to one another.

Figure 2:
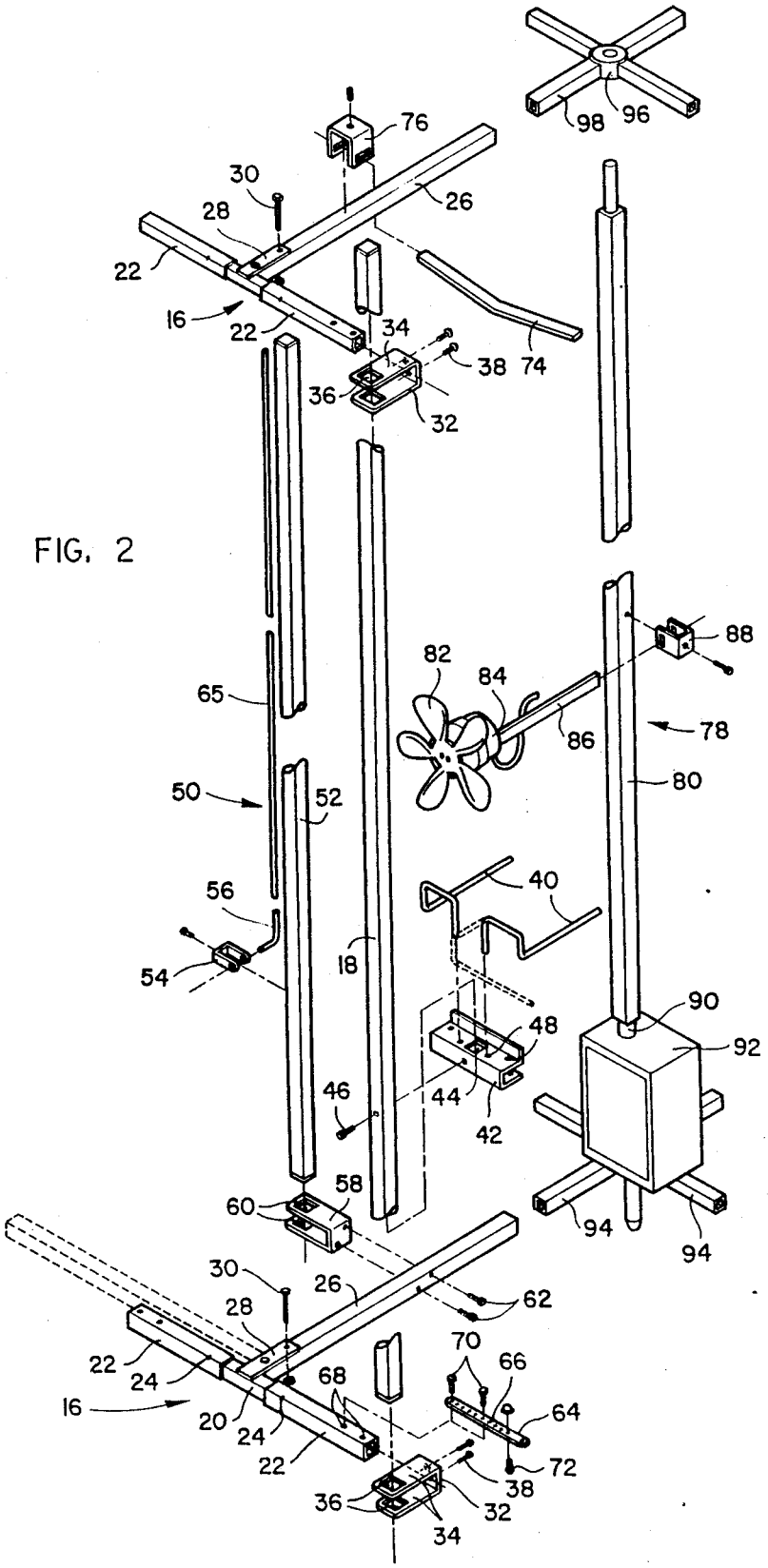
FIG. 2 is a partial exploded perspective view of the differing components of the creel of the FIG. 1.

Another frame member 26 is pivotably mounted centrally to the main frame member 20 by a bracket 28 welded to the main frame member 20 for selective pivotal movement between a folded inoperative storage disposition wherein the frame member 26 extends alongside the main and auxiliary frame members 20, 22, as shown in broken lines in FIG. 2, and an operative erected disposition wherein the frame member 26 extends perpendicularly outwardly from the main frame member 20, as shown in full lines in FIG. 2. The bracket 28 and the frame member 26 are provided with respective openings which align with one another in the operative disposition of the frame member 26 to receive a bolt 30 to fix the frame member 26 in such disposition.

Each opposite end of each yarn package supporting member 18 is rigidly mounted to a respective one of the auxiliary frame members 22 by a C-shaped bracket 32 configured to conform to the cross-section of the auxiliary frame members 22. The projecting bracket arms 34 of each bracket 32 are of sufficient length to extend beyond the associated auxiliary frame member 22 when mounted thereon and the arms 34 are formed with aligned openings 36 conforming to the cross-section of the yarn package supporting members 18 to receive a respective end thereof. The central portion of each bracket 32 carries a pair of set screws 36 by which the described assembly of the auxiliary frame member 22, the bracket 32 and the yarn package supporting member 18 may be selectively rigidified upon assembly or loosened for disassembly.

A plurality of yarn package mounting arms 40 are affixed at spacings along each yarn package supporting member 18 by a corresponding plurality of mounting brackets 42. Each mounting bracket 42 is of a generally C-shaped cross-section with a pair of aligned openings 44 through which the respective yarn package supporting member 18 is slidably received. The central portion of the mounting bracket 42 carries a set screw 46 for rigidly securing the mounting bracket 42 at any selected position along the length of the associated yarn package supporting member 18. Each mounting bracket 42 is of a sufficient length to extent laterally outwardly from opposite sides of its associated yarn package supporting member 18, each opposite end of the mounting bracket 42 being formed with one or more sets of aligned holes 48 for pivotably supporting a mounting end of one yarn package mounting arm 40. Thus, each mounting bracket 42 supports a pair of the yarn package mounting arms 40 at the respective laterally opposite sides of the associated yarn package supporting member 18. Each mounting arm 40 is pivotable with respect to its mounting bracket 42 between an operative yarn feeding disposition wherein the arm 40 extends radially inwardly with respect to the circular arrangement of the yarn package supporting assemblies 12, as shown in full lines in FIG. 2, and an inoperative package mounting disposition wherein the arm 40 extends outwardly from the circular arrangement of yarn package supporting assemblies 12 for easy placement of a yarn package thereon. As those persons skilled in the art will understand, each associated pair of the mounting arms 40 support one pair of active and replacement yarn packages as aforedescribed.

Each yarn package supporting assembly 12 further includes a yarn guiding sub-assembly, generally indicated at 50. The yarn guiding sub-assembly 50 has a longitudinal frame member 52 mounted at its opposite ends to the respective frame members 26 of the upper and lower, frame sub-assemblies 16 by a pair of C-shaped brackets 58 of substantially the same construction as the brackets 32 each having aligned openings 60 to receive a respective end of the frame member 52 and set screws 62 to fix the bracket 58 rigidly to the frame member 26 . A plurality of L-shaped tubular yarn guide members 56 are mounted along the frame member 52 by C-shaped brackets 54. One yarn guide member 56 is provided for each pair of yarn package mounting arms 40 with each guide member 56 being positioned by its supporting bracket 54 in horizontally adjacent facing relation to its associated pair of mounting arms 40. The opposite end of each yarn guide member 56 is attached to an end of a flexible yarn guide tube 65 which extends upwardly through the creel 10 along the associated frame member 52 and therefrom overhead to a respective yarn feeding location of the knitting machine or other textile apparatus associated with the creel 10.

The lower end of each yarn package supporting member 18 and the yarn guiding frame member 52 of each yarn package supporting assembly 12 provides a floor-engaging foot to enable the yarn package supporting assembly 12 to be capable of free-standing upright disposition on a floor or other suitable horizontal supporting surface. The plural yarn package supporting assemblies are disposed in upstanding side-by-side relation to one another in a substantially circular arrangement with the respective frame members 26 and yarn package mounting arms 40 of each yarn package supporting assembly 12 oriented to extend radially inwardly with respect to the circular arrangement, each yarn package supporting assembly 12 being joined with the laterally adjacent yarn package supporting assemblies 12 by the aforementioned connecting assemblies 14.

Each connecting assembly 14 includes a pair of connector plates 64 each of which is formed with a plurality of openings 66 at spacings along its length. Each auxiliary frame member 22 of each frame sub-assembly 16 of each yarn package supporting assembly 12 is formed at its outward end with two sets of aligned openings 68. One connector plate 64 is affixed to extend co-linearly outwardly from each auxiliary frame member 22 by a pair of bolts 70 extended through a selected pair of the openings 66 in the connector plate 64 and the openings 68 in the auxiliary frame member 22, the plurality of openings 66 in each connector plate 64 permitting the outward extension of the connector plate 64 from the auxiliary frame member 22 to be selectively determined. The connector plates 64 extending outwardly from adjacent yarn package supporting assemblies 12 in the circular arrangement thereof are connected with one another by bolts 72 extended through the respective outermost openings 66 in the connector plates 64. In this manner, the lateral spacing of the plural yarn package supporting assemblies 12 from one another and, in turn, the overall diameter of the creel 10 may be selectively determined. For additional stability in the connection and integration of the yarn package supporting assemblies 12, each frame member 26 of each upper frame sub-assembly 16 of each yarn package supporting assembly 12 is similarly connected to the upper frame members 26 of adjacent yarn package supporting assemblies 12 by connector bars 74 rigidly affixed by C-shaped brackets 76 to the frame members 26 to extend laterally therebetween.

A rotary fan assembly, generally indicated at 78, is provided at the axial center of the creel 10. The fan assembly 78 includes a plurality of electrically-operated fans 82 of the rotary paddle-wheel type, each of which has its motor 84 affixed to a L-shaped support arm 86, the plural fans 82 being mounted by their respective support arms 86 at spacings along the length of a common longitudinal fan support member 80 by C-shaped brackets 88 similar to the brackets 32 and 54. The brackets 88 and the support arms 86 orient the fans 82 with the rotational axes of their paddle wheels essentially radially with respect to the common fan support member 80 so that the paddle wheels face and move ambient air radially outwardly from the fan support member 80. Preferably, the brackets 88 are affixed to the common fan support member 80 to orient the axes of the fans 82 at circumferential spacings about the fan support member 80 so that the paddle wheels of the fans 82 face outwardly in differing directions.

The common fan support member 80 is supported in upstanding disposition at the axial center of the circular arrangement of the yarn package supporting assemblies 12 with the lower end of the support member 80 affixed to the upstanding drive shaft 90 of an electric drive motor 92 by which the fan support member 80 and the fans 82 mounted thereon are rotated about the central axis of the creel 10. To support the rotary fan assembly 78 in the described upstanding disposition and integrate it with the yarn package supporting assemblies 12 of the creel 10, a plurality of frame members 94 are affixed to the underside of the housing of the drive motor 92 to extend radially outwardly therefrom for receipt within the tubular ends of respective ones of the frame members 26 of the lower frame sub-assemblies 16 of the yarn package supporting assemblies 12. Likewise, the upper end of the common fan support member 80 may be rotatably supported within a bearing 96 which likewise has a plurality of radially outwardly extending frame members 98 received within respective frame members 26 of the upper frame sub-assemblies 16 of the yarn package supporting assemblies 12.

The use and operation of the creel 10 may thus be understood by those persons skilled in the art. The creel 10 is initially set up and assembled with a suitable number of the yarn package supporting assemblies 12 with each of the yarn package supporting members 18 thereof equipped with a suitable number of pairs of the yarn package mounting arms 40 so that the creel 10 is adapted to hold a pair of yarn packages for each yarn feeding station or position of the textile machine associated with the creel. As aforementioned, while one yarn package of each pair is in active operation delivering yarn to the associated yarn feed of the textile machine, the other package of the pair is inactive awaiting exhaustion of the yarn from the active yarn package. The trailing end of yarn from the active yarn package of each pair is tied to the leading yarn end of the associated inactive replacement package so that, when the active yarn package is exhausted of yarn, yarn feeding continues uninterrupted from the inactive yarn package. The exhausted yarn package core is then removed from its mounting arm 40 and replaced by a full yarn package, the leading end of which is then tied to the trailing end of the associated package. In this manner, yarn feeding operation of the creel 10 can proceed continuously without interruption for maximum efficiency and minimal down-time of the associated textile machine. The mounting arms 40 on which the yarn packages are supported extend radially inwardly of the creel 10, as aforementioned, so that yarn is delivered in a radially inward direction into and through the associated yarn guide member 56 and yarn guide tube 65 for delivery to the associated textile machine.

As will be understood by those persons skilled in the art, a substantial advantage of the creel 10 is its varied adjustability. Virtually any number of the yarn package supporting assemblies 12 may be circularly arranged to form a creel 10 of virtually any yarn package capacity. Furthermore, each yarn package supporting assembly 12 offers numerous adjustments. Specifically, the auxiliary frame members 22 of the frame sub-assembly 16 are slidably positionable inwardly and outwardly with respect to one another along the opposite ends of the main frame members 20, while additionally the yarn package supporting members 18 may be affixed by the C-shaped brackets 32 at any location along the auxiliary frame members 22, whereby the lateral spacing of the yarn package supporting members 18 of each yarn package supporting assembly 12 may be selectively varied. Likewise, the mounting brackets 42 may be positioned in varying numbers and spacings along each yarn package supporting member 18 to increase or decrease, as necessary or desirable, the number of yarn package pairs supported on each yarn package supporting member 18. The C-shaped brackets 54 enable the yarn guiding sub-assembly 50 of each yarn package supporting assembly 12 to be selectively positioned radially inwardly and outwardly along the frame members 26 toward and away from the yarn package supporting members 18 to adjust the angle at which yarns are withdrawn from the packages supported on the yarn package supporting members 18. The plurality of openings 66 in the connector plates 64 enable the lateral spacing of the yarn package supporting assemblies 12 to be selectively adjusted as well. Finally, the frame members 94, 98 of the rotary fan assembly 78 allow it to be positioned at the axial center of any arrangement of the yarn package supporting assemblies 12. The axial and circumferential spacing of the fans 82 along the common fan support member 80 along with the rotation of the fan support member 80 by the drive motor 92 serves to move ambient air radially outwardly from the center of the creel across the yarn package supporting assemblies 12 and the yarn packages thereon about the full circumference and for the full height of the creel 10 to blow off the creel 10 any lint accumulating thereon and to blow away from the creel 10 any airborne lint. The fans 82 and the motor 92 may be arranged for continuous or periodic operation as necessary or desirable for appropriate lint control.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A textile yarn creel for compactly and adjustably supporting a plurality of yarn packages for feeding yarns therefrom to a textile knitting machine or like textile apparatus, said creel comprising a plurality of yarn package supporting means each including frame means, at least one longitudinal yarn package supporting member having a plurality of yarn package mounting locations therealong, and means for mounting said yarn package supporting member at selectively variable positions on said frame means; and means for selectively connecting the plurality of said frame means in an annular arrangement with their respectively associated yarn package supporting members oriented in axial relation to the annular arrangement and generally parallel spaced relation to one another and with their yarn package mounting locations facing radially inwardly of the annular arrangement.

2. A textile yarn creel according to claim 1 and characterized further in that each said yarn package supporting means comprises a pair of said yarn package supporting members, the associated mounting means being arranged for mounting said pair of said yarn package supporting members in generally parallel relation at selectively variable spaced positions on the associated frame means.

3. A textile yarn creel according to claim 2 and characterized in that each said frame means includes a main frame member and a pair of auxiliary frame members movably mounted in opposition to one another on said main frame member, the associated mounting means being arranged for mounting the associated pair of said yarn package supporting members respectively to said pair of auxiliary frame members for selective relative positioning of said yarn package supporting members.

4. A textile yarn creel according to claim 3 and characterized further in that each said frame means includes another frame member pivotably mounted centrally to said main frame member for movement between an operative position extending outwardly from said main frame member and a storage position extending alongside said main frame member, each said yarn package supporting means including a longitudinal yarn guiding means mounted to said another frame member in generally parallel relation to said pair of said yarn package supporting members for disposition of said yarn guiding means in axial relation to the annular arrangement of said yarn package supporting means radially inwardly of said pair of said yarn package supporting members when said another frame member is in its said operative position for receiving the yarn withdrawn from the yarn packages at said yarn package mounting locations of said yarn package supporting members.

5. A textile yarn creel according to claim 1 and characterized further in that each said yarn package supporting means comprises a plurality of yarn package mounting elements and a plurality of brackets selectively mountable at varying locations along said yarn package supporting member for supporting said yarn package mounting elements for forming said yarn package mounting locations.

6. A textile yarn creel according to claim 1 and characterized further by fan means disposed centrally of the annular arrangement of said yarn package supporting means for removing and preventing lint accumulation thereon.

7. A textile yarn creel according to claim 6 and characterized further in that said fan means comprise a plurality of rotary fans facing radially outwardly of the annular arrangement of said yarn package supporting means at axial and circumferential spacings of said fans to one another.

8. A textile yarn creel according to claim 7 and characterized further in that said fan means comprises a common fan support member to which said plurality of fans is mounted and means for rotating said fan support member about an axis extending generally axially of the annular arrangement of said yarn package supporting means.

9. A textile yarn creel comprising means for supporting a plurality of yarn packages in an annular arrangement, and fan means disposed centrally of the annular arrangement of said yarn packages for removing and preventing lint accumulation on said supporting means and on said yarn packages, said fan means comprising a fan support member disposed axially centrally of the annular arrangement of said yarn packages, a plurality of rotary fans mounted to said fan support member and facing radially outwardly of the annular arrangement of yarn packages at axial and circumferential spacings of said fans to one another, and means for rotating said fan support member about an axis extending generally axially of the annular arrangement of said yarn packages.

* * * * *